United States Patent [19]

Mounsdon

[11] 4,029,297

[45] June 14, 1977

[54] WINCHES FOR USE WITH HIGH MASTS

[75] Inventor: Maurice Hewlett Mounsdon, London, England

[73] Assignee: The General Electric Company Limited, London, England

[22] Filed: Oct. 8, 1975

[21] Appl. No.: 620,642

[30] Foreign Application Priority Data

Oct. 11, 1974 United Kingdom ..... 44105/74

[52] U.S. Cl. ..... 254/139; 240/84; 248/317

[51] Int. Cl.[2] ..... B66C 23/60

[58] Field of Search ..... 254/183, 186 HC, 184, 254/185, 146, 134; 248/317, 320; 240/84

[56] References Cited

UNITED STATES PATENTS

| | | | |
|---|---|---|---|
| 79,772 | 7/1868 | Palmer | 254/185 |
| 1,019,500 | 3/1912 | Libby | 254/185 |
| 1,354,247 | 9/1920 | Fredrickson | 254/185 |
| 3,273,860 | 9/1966 | Weisenbach | 254/184 |
| 3,840,212 | 10/1974 | Latanision | 254/139 |

*Primary Examiner*—Albert J. Makay
*Assistant Examiner*—Donald W. Underwood
*Attorney, Agent, or Firm*—Kirschstein, Kirschstein, Ottinger & Frank

[57] ABSTRACT

A double-rope winch, which is designed for supporting a load such as a lantern carriage from the top of a high mast, has a primary drum which receives one of the ropes and is provided with driving means to which a winch-operating tool can be connected, and a secondary drum which receives the other rope and is connectable to the primary drum through a linkage including engageable means, so that both drums can be driven together for raising and lowering the load when said drums are connected by the engageable means but so that when the latter is not engaged the primary drum can be driven by itself for balancing the load. The linkage may consist of an endless band passing round both of a pulley keyed to the secondary drum drive shaft and a pulley which is rotatable on the primary drum drive shaft and is provided with dogs which can be drivably engaged or not, as required, by a winch-operating tool applied to the primary drum drive shaft.

5 Claims, 6 Drawing Figures

WINCHES FOR USE WITH HIGH MASTS

This invention relates to a winch of the kind (hereinafter referred to as the kind specified) designed for use with a high mast and to receive a pair of ropes which in use pass up the mast and over pulleys at or near the top to respective attachment points on a load at which the load is normally balanced so that it can be raised or lowered by the simultaneous winding of both ropes on to or off the winch, each rope being of sufficient strength as by itself to take the weight of the load.

More particularly, but not exclusively, the invention relates to such a winch designed to be accommodated within the base of a high-mast hollow tubular lighting column for use with ropes which pass up the interior of the column to attachment points on a lantern carriage fitted round the mast which supports one or more lighting fittings, so that by operation of the winch the lantern carriage can be lowered to or near to ground level for maintenance of the lighting fittings and subsequently raised again to the operating position at or near the top of the mast, which may, for example, be about 80 to 100 feet high.

In such arrangements it is desirable that the load should always be evenly supported by the two ropes to ensure its correct balance, and this is especially of importance when, as is usually the case, a maintenance cage is to be attached to the ropes, either together with or in place of the lantern carriage, for carrying one or more operators and their tools up or down the mast. To ensure such balance, it is necessary to arrange that the length of one of the ropes can be slightly adjusted relative to the length of the other rope both on installation of the mast and from time to time during the use of it.

One object of this invention is to provide a winch which includes a safe and effective means for enabling such a balancing adjustment to be made.

According to the invention, a winch of the kind specified includes a primary drum arranged for receiving one of said ropes and provided with driving means to which a turning handle or a motor can be connected for operating the winch, and a secondary drum which is arranged for receiving the other rope and which is connectable to the primary drum or its driving means through a linkage including engageable means, the arrangement being such that the secondary drum can be driven only when connected to the primary drum through said linkage by the engagement of said engageable means, so as then to be drivable together with the primary drum, but when said engageable means is disengaged the secondary drum is disconnected from the primary drum and the latter can be driven without the secondary drum being driven.

The directions of rotation of the primary and secondary drums when driven together following the engagement of the said engageable means must, of course, be such, relative to the sense of winding of the ropes on them, that the ropes are wound either both on to or both off the drums.

When balancing of the load is required, the said engageable means is disengaged and the primary drum driven slightly in the sense required to achieve the balance, which might, for example, be obtained by visual inspection or by bringing into alignment prearranged markers on the ropes near the winch or by bringing the load into abutment with both of two stops carried by a head frame fixed to the mast at or near its top. In some cases means may be provided for holding the secondary drum locked against rotation throughout this balancing process, but in other cases there may be sufficient friction built into the drum drives to render this unnecessary.

It will, in general, be required to provide both drums with safety catches which hold them against a rotation which would permit the load to descend in normal use (i.e. when no driving of the drums is taking place).

In some cases the said engageable means of a winch in accordance with the invention may include a clutch mechanism of conventional kind e.g. a friction clutch or sliding dog clutch) but different forms of mechanically engageable means may be used (e.g. shafts connectable through pins, splines, sliding collars or the like).

Three embodiments of the invention will now be described by way of example with reference to the accompanying schematic drawings in which FIG. 1 shows a view end on to the winch drums, with a manual operating handle adjacent thereto.

Figure 6:
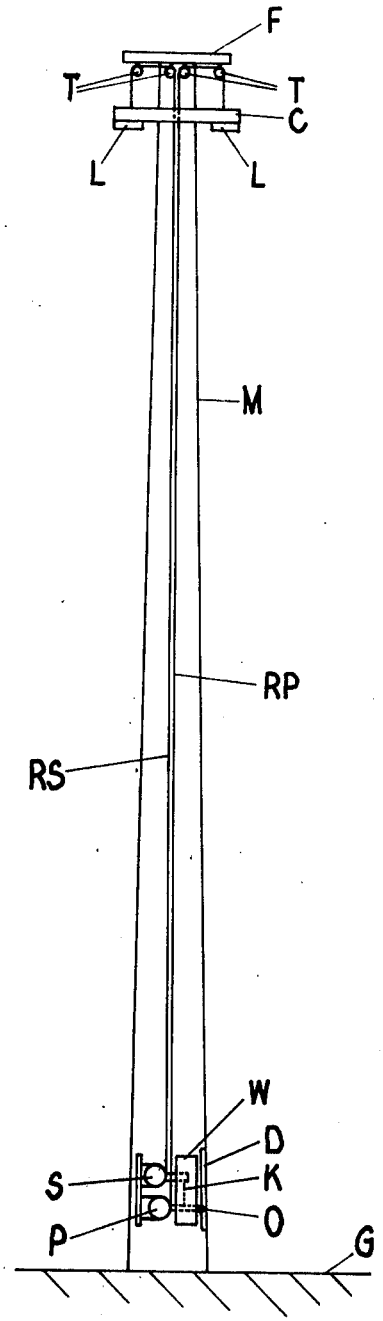
FIG. 6 shows schematically a lighting column fitted with a winch in accordance with the invention.

Referring first to FIG. 6, this shows a long hollow steel mast M upstanding from the ground G to which it is secured and containing a winch W fixed in a compartment at its base, which compartment is closed by a door D through which access can be had to the drive shaft O of the winch.

To the top of the mast M is fixed a transverse frame F which carries pulley wheels T round which ropes RP and RS extending upwards along the mast from the winch W are turned so that their ends support a dependent lantern carriage C which is fitted round the mast and to which are secured lighting fittings represented by L. Electrical supply leads for the fittings also pass upwards within the mast from mains connections at its base but these are not shown since they are not directly relevant to the present invention.

The winch W is provied with a primary drum P which receives the rope RP and a secondary drum S which receives the rope RS, the drive shafts of the drums being connected through a disengageable linkage represented by the line K, but only the drive shaft O of the primary drum P being exposed for attachment when required to driving means such as an electric motor (not shown) or a manual turning handle (not shown).

The linkage K and rope windings are such that when both drums are rotated together following engagement of the linkage and driving of the primary drum P, the ropes are wound off or on the drums simultaneously for the lowering or raising of the lantern carriage.

When the linkage K is disengaged only the primary drum P is driven and only the rope RP wound off or on to its drum, so that a balancing of the lantern carriage can thereby be achieved.

When required, a maintenance cage (not shown) can be attached to the ropes additionally to or in place of the lantern carriage and each of the ropes is strong enough by itself to support the maximum weight of the lantern carriage and loaded maintenance cage.

Figure 1:
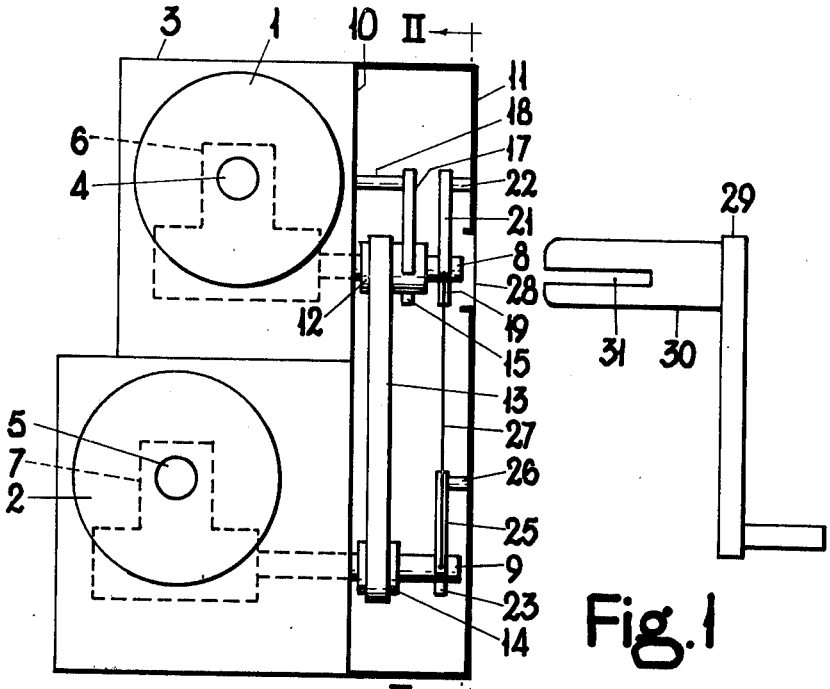
Figure 2:
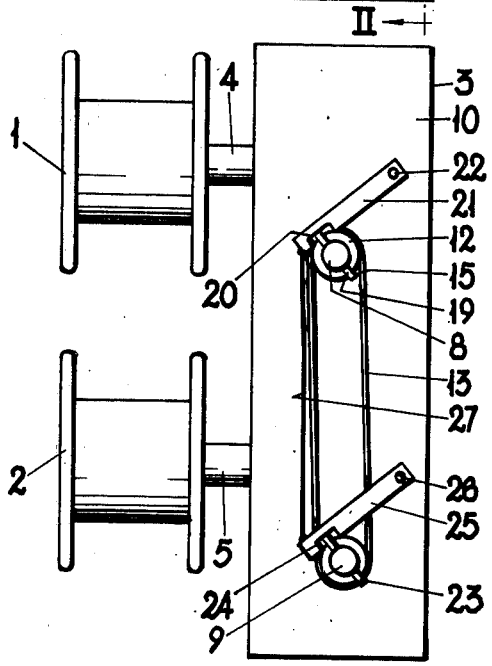
FIG. 2 shows a side view, in the plane II—II of FIG. 1.

Referring now to FIGS. 1 and 2, in this embodiment, the winch comprises a primary drum 1 and a secondary drum 2 mounted one above the other on a frame 3, with the axis of the lower drum offset horizontally to permit the rope (not shown) carried by it to pass upwards clear of the upper drum in use.

The axles 4, 5 of the drums 1, 2 are connected through reduction gearing, indicated schematically at 6, 7 in FIG. 1, to horizontal drive shafts 8, 9 which extend into an enclosed space bounded by the walls 10, 11 of the frame 3 and side walls not shown.

The drive shaft 8 of the primary drum 1 carries adjacent the wall 10 a primary pully member in the form of a sprocket sleeve 12 rotatably mounted on the shaft and carrying a chain 13 which engages a secondary pulley member in the form of a sprocket sleeve 14 fixed to the drive shaft 9 of the secondary drum 2 adjacent the wall 10.

The sleeve 12 carries between the chain 13 and the wall 11 two diametrically opposite dogs in the form of pins 15 which are arranged to engage in a rectangular notch 16 in a latch bar 17 pivoted on a horizontal stub shaft 18 carried by the wall 10, the latch bar serving to hold the sprocket sleeve 12 locked against rotation in either direction when one of the pins 15 fits into the notch 16. The notch 16 is hidden in the drawings, coinciding with the notch 20 in FIG. 2.

Between the sleeve 12 and its end nearer the wall 11, the drive shaft 8 carries two further diametrically opposite dogs in the form of pins 19 which are arranged to engage the rectangular notch 20 of a second latch bar 21 pivoted on a stube shaft 22 projecting inwards from the wall 11, the latch bar 21 serving to hold the shaft 8 locked against rotation in either direction when one of the pins 19 fits into the notch 20.

The shaft 9 also carries two diametrically opposite dogs in the form of pins 23 near its end adjacent to the wall 11 which are arranged to enter a rectangular notch 24 in a third latch bar 25 pivoted on a stub shaft 26 projecting inwards from the wall 11, the latch bar 25 serving to hold the shaft 9 locked against rotation in either direction when one of the pins 23 fits into the notch 24.

The notch end of the latch bar 21 is linked with the notch end of the latch bar 25 through a wire, chain, cord or the like link 27 so that the raising of the latch bar 21 automatically results in raising of the latch bar 24 but so that when both latch bars are lowered against their respective shafts, the link 27 can give to permit the latch bar 25 to be lifted by the pins 23 to the extent required to permit one of these pins to enter the notch 24 as the shaft 9 rotates and thereby lock the shaft against further rotation in either direction.

The wall 11 is provided with an aperture 28 opposite the drive shaft 8 of just sufficient width to permit the entry of a winch-operating tool 29, shown as a manual handle but which could equally well be an electrically driven tool or the like.

The tool 29 is formed with an operating shaft 30 having a bore designed to fit over both the shaft 8 and the sprocket sleeve 12 and formed with slots designed to accommodate the pins 19 and 15, the front end of the shaft also being bevelled for operating the latch bars 17 and 22.

To operate the winch, the shaft 30 of the tool 29 is pushed part way into the aperture so that its front end first raises the latch bar 21 and causes the pins 19 to enter the slots 31.

The raising of the latch bar 21 automatically raises the latch bar 25 but the secondary drum 2 remains locked against rotation by the latch bar 17.

As the shaft 30 of the operating tool is pushed fully home, its end fits over the sprocket sleeve 12, raises the latch bar 17 and causes the pins 15 to enter the slots 31, the latter thereby serving to engage the pins 15 with the pins 19 and connect together the primary and secondary drums.

The raising of the latch bar 17 releases the shaft 9 and on rotation of the tool 29 the primary drum is driven directly via the shaft 8 and reduction gear 6 whilst the secondary drum is simultaneously driven via the chain 13, shaft 9 and reduction gear 7.

In some cases the reduction gear 7 can be omitted and replaced by a cheaper and simpler coupling since the secondary drum can only be driven whilst the primary drum is being driven, being locked against rotation at all other times, and a single reduction gear 6 can be arranged to serve adequately for the driving of both drums.

When it is desired to make a balancing adjustment of the ropes carried by the drums, the tool shaft 29 is inserted only to the extent required to lift the latch bar 21 and engage the pins 19. Rotation of the tool then rotates the primary drum, but the latch bar 17 holds the sleeve 12 against rotation and the shaft 8 merely turns within the sleeve 12.

To ensure a firm and positive engagement of the tool shaft 29 with the pins 19 in the balancing adjustment position, the sides of the aperture 28 can be arranged to position the tool, or alternatively or additionally the bore of the tool shaft 30 can be provided with a rotationally fixed but slidable slotted insert (not shown) pushed forward by a spring (not shown), the insert having a bore which just fits over the shaft 8, with the pins 19 entering the slots of the insert, to enable the balancing adjustment to be made.

When driving of both drums of the winch is required, the tool shaft is pushed fully in and the insert then slides backwards against the spring bias after the end of the insert has abutted the end of the sleeve 12.

Figure 3:
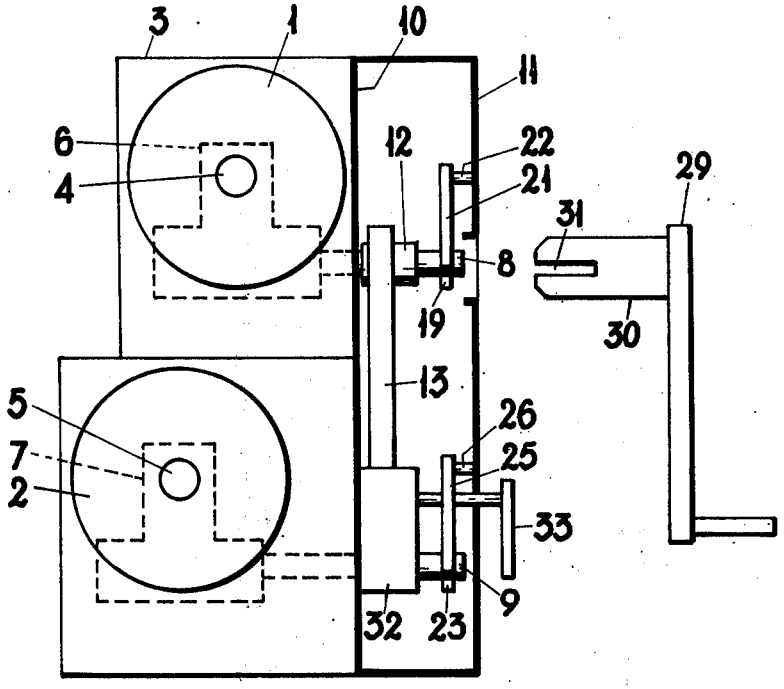
FIG. 3 shows a view, similar to that of FIG. 1, of the second embodiment.

FIG. 3 illustrates a second embodiment of the invention which is a modification of that described with reference to FIGS. 1 and 2 with corresponding reference numerals denoting corresponding parts.

In this modification, the pins 15, latch bar 17 and shaft 18 of FIGS. 1 and 2 are omitted and the latch bar 21 is not linked with the latch bar 25, the linkage 27 being omitted. Also the sprocket sleeve 12 is fixed to the shaft 8.

The chain 13 now passes to a clutch mechanism 32 which is arranged to cause the chain 13 to drive the shaft 9 only when the clutch is engaged by rotation of the operating lever 33 the shaft of which passes adjacent to the latch bar 25 and carries a cam (not shown) which lifts the latch bar to unlock the shaft 9 as the lever 33 is rotated to engage the clutch 32.

The shaft 30 of the tool 29 is now dimensioned merely to receive the end of the shaft 8 and the pins 19. When engaged therewith, and with the clutch 32 engaged, the primary drum shaft 8 will be directly driven by rotation of the tool 29 and the secondary shaft 9 driven from the primary drum shaft through the chain 13.

When the clutch 32 is disengaged, the primary drum shaft can be rotated by itself to effect a balancing adjustment, whilst the secondary drum shaft is held locked by the latch 25. Additional locking means can readily be built into the clutch mechanism if required.

As in the emboodiment of FIGS. 1 and 2, the reducton gearing 7 can be replaced by a simpler and cheaper form of drive if required.

Figure 4:
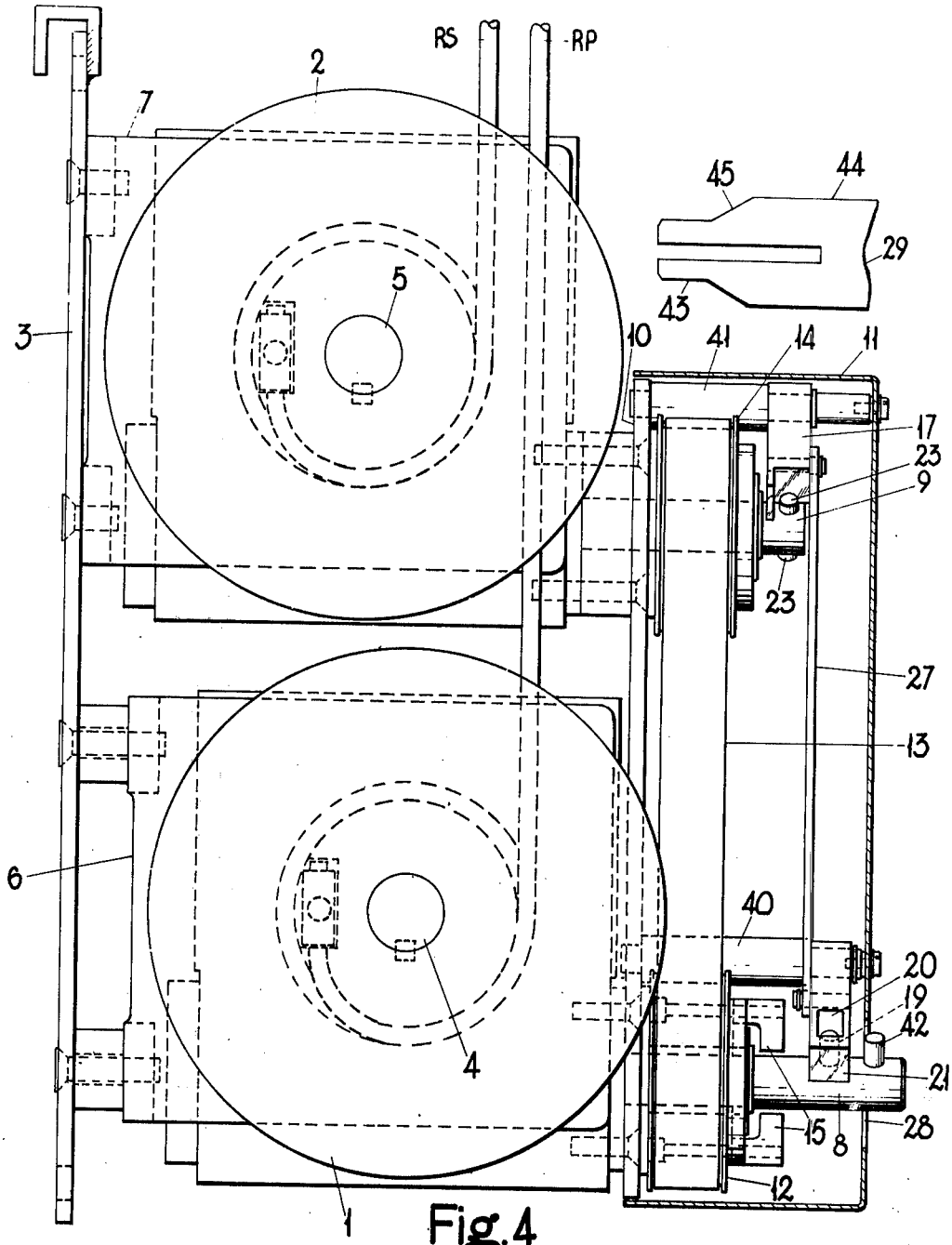
FIGS. 4 and 5 show views similar to those of FIGS. 1 and 2 respectively, of a third embodiment of the invention.
Figure 5:
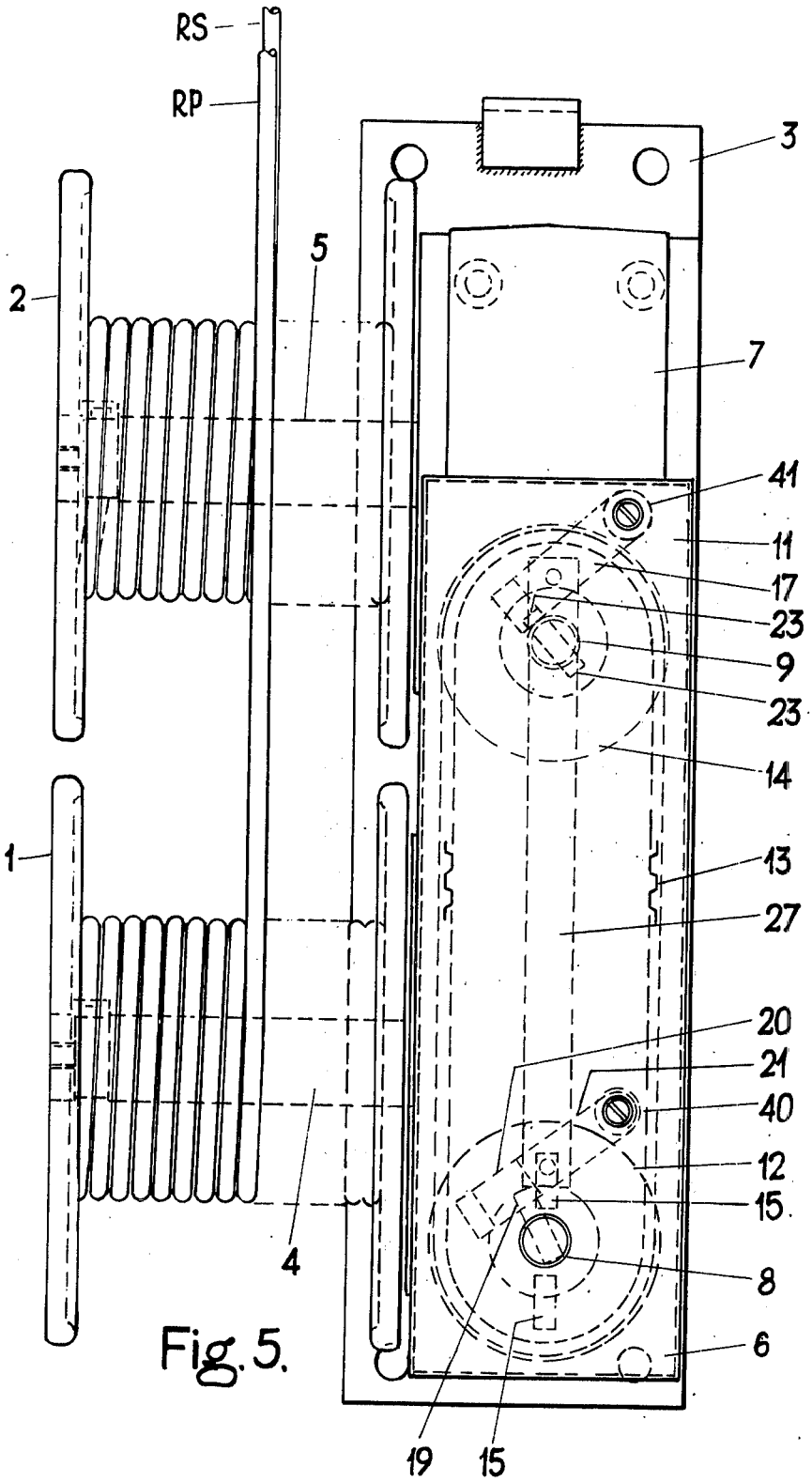

Referring now to FIGS. 4 and 5, the winch shown therein is similar to that shown in FIGS. 1 and 2 but the primary drum is now the lower drum and the secondary drum is the upper drum. Parts in FIGS. 4 and 5 which correspond to similar parts in FIGS. 1 and 2 are denoted by the same reference numerals.

Thus the winch comprises a primary drum 1 and a secondary drum 2 mounted on below the other on a frame 3, with the axis of the lower (primary) drum offset to permit the rope RP carried by it to pass upwards clear of the upper (secondary) drum and rope RS carried by it.

The axles 4, 5 of the drums 1, 2 are connected to driveshafts 8, 9 through reduction gearing 6, 7 in gear cases (also denoted by these reference numerals) attached to the frame 3. The drive shafts extend into an enclosed space formed by a base plate 10 secured to the gear cases 6, 7 and a detachable dished cover 11 screwed to pillars 40, 41 set into and upstanding from the base plate 10.

The drive shaft 8 of the primary drum carries adjacent the base plate 10 a free-running primary pulley member in the form of a pully wheel 12 which has a pair of diametrically opposed dogs of L-shape 15 projecting from its face away from the base plate. The pulley wheel 12 carries a flexible link belt 13 of strong reinforced plastics material which passes also round a secondary pulley member in the form of a pulley wheel 14 keyed to the drive shaft 9 of the upper (secondary) drum 2 adjacent to the plate 10.

The free end of the secondary drive shaft 9 carries two diametrically opposite dogs in the form of pins 23 which are arranged to engage a shoulder formed at the end of a latch bar 17 pivotally mounted on the pillar 41 when the shaft turns in the direction of pull-off of the rope RS.

The free end of the primary drive shaft 8 projects through a hole 28 formed in the cover 11 and carries at the hole a drive pin 42 which extends near to the edge of the hole. Between the pulley wheel 12 and the cover 11 the shaft 8 also carries a latch pin which is vertically aligned with the pins 23 and is arranged to fit into a hole 20 provided in a latch bar 21 pivotally mounted on the pillar 40, so that with either direction of rotation of the shaft 8 the pin 15 will enter the hole 20 and lock the shaft against further rotation.

The latch bars 17 and 21 are linked through a rigid metal strap 27 pivotally attached to each of them so the raising or lowering of the latch bar 21 to clear or engage the pin 19 will result in the raising or lowering of the latch bar 17 to clear or engage the pins 23.

The tool 29 designed for operating both drive shafts 8 and 9 simultaneously is formed with an operating shaft which fits into the hole 28 and is slotted for just sufficient of its length to engage all of the pins 42, 19 and the dogs 15 when pushed fully home.

As shown in FIG. 4 the tool shaft has a relatively small diameter front part 43 and a relatively wide diameter rear part 44 connected by a chamfered intermediate part 45, the axial lengths of these parts being such that as the tool is inserted through the hole 28, the chamfered part 45 engages the latch bar 21, just before the front part reaches the dogs 15, and then raises the latch bar clear of the pin 19 as the shaft is pushed home to engage the dogs 15. Rotation of the tool shaft then drives both the primary drum and secondary drum simultaneously.

As the tool shaft is withdrawn, the chamfered part 45 permits the latch bar 21 to fall and engage the pin 19 as soon as the front part clears the dogs 15, and the shaft 8 is then locked against rotation, so that there is no possibility of the primary shaft being driven by the tool independently of the secondary shaft.

For such simultaneous driving of the shafts, the tool with shaft as described will usually be a power driven tool.

For balancing purposes, when it is required to drive only the shaft 8 and primary drum 1, a second tool (which may conveniently be a manual tool) having a shaft slotted only to such axial length as to engage the pins 42 and 19 (i.e. too short to reach also the dogs 15) is used, the front end of the shaft being shaped to raise the latch bar 21 as the tool is inserted into the hole 28.

Although the raising of the latch bar 21 will then also raise the latch bar 17, the shaft 9 of the primary drum will not be driven since the dogs 15 are not engaged and because of the vary large degree of friction present in the drum drives, which can be increased by the use of friction washers if required.

I claim:

1. A winch designed for use with a high mast and to receive a pair of ropes which in use pass up the mast and over pulleys to support a load for raising and lowering the load, and which includes a primary drum arranged for receiving one of said ropes provided with driving means to which a winch-operating tool can be connected for operating the winch, a secondary drum arranged for receiving the other rope, a primary pulley member rotatably mounted on the drive shaft of the primary drum, a secondary pulley member mounted on and keyed to the shaft of the secondary drum, and an endless band passing round and drivably linking the pulley members, the primary pulley member being provided with engagement means which can be engaged by the winch-operating tool simultaneously with the engagement of that tool with the drive shaft of the primary drum so that the secondary drum and the primary drum are then drivable together by the winch-operating tool, but when said tool is disengaged from the primary pulley member the secondary drum is disconnected from the primary drum and the latter can be driven by the winch-operating tool without the secondary drum being driven.

2. A winch according to claim 1, wherein the primary pulley member and the primary drive shaft are both provided with dog projections which can be engaged simultaneously by the same slot in the drive shaft of a winch-operating tool having a slotted rotatable drive shaft.

3. A winch according to claim 2, wherein the drives to the primary and secondary drums are enclosed so that the drive shaft of the winch-operating tool can be inserted for operating the winch only through an aperture in the enclosure wall adjacent to the primary drum shaft for engagement of the tool with that shaft.

4. A combination comprising a hollow tubular high mast lighting column having a compartment at the foot thereof, a winch in said compartment, a pair of ropes passing up the interior of said column, pulleys carried by said mast and over which the ropes are trained to support a load in the form of a lantern carriage, said ropes being driven by said winch to raise and lower the load, said winch including a primary drum arranged for receiving one of said ropes provided with driving means to which a winch-operating tool can be connected for operating the winch, a secondary drum arranged for receiving the other rope, a primary pulley member rotatably mounted on the drive shaft of the primary drum, a secondary pulley member mounted on and keyed to the shaft of the secondary drum, and an endless band passing round and drivably linking the pulley members, the primary pulley member being provided with engagement means which can be engaged by the winch-operating tool simultaneously with the engagement of that tool with the drive shaft of the primary drum so that the secondary drum and the primary drum are then drivable together by the winch-operating tool, but when said tool is disenaged from the primary pulley member the secondary drum is disconnected from the primary drum and the latter can be driven by the winch-operating tool without the secondary drum being driven.

5. A combination as set forth in claim 4, wherein the compartment has a door which can be opened to permit the winch-operating tool to have access to the drive shaft of the primary drum.

* * * * *